US006089565A

United States Patent [19]

Voorhees et al.

[11] Patent Number: 6,089,565

[45] Date of Patent: Jul. 18, 2000

[54] STOP WHEEL ASSEMBLY AND METHOD FOR WEB-PRODUCT DELIVERY SYSTEM

[75] Inventors: Philip V. Voorhees, Willowbrook; Charles A. Steinhauer, Naperville; Charles H. Bridges, Kildeer, all of Ill.

[73] Assignee: Western Printing Machinery Company, Schiller Park, Ill.

[21] Appl. No.: 09/061,522

[22] Filed: Apr. 16, 1998

Related U.S. Application Data

[63] Continuation-in-part of application No. 09/005,220, Jan. 9, 1998.

[51] Int. Cl.[7] ..... B65H 29/68

[52] U.S. Cl. ..... 271/182; 271/273; 271/216

[58] Field of Search ..... 271/182, 273, 271/189, 191, 216; 198/836.2

[56] References Cited

U.S. PATENT DOCUMENTS

| | | | |
|---|---|---|---|
| 3,241,665 | 3/1966 | Erk | 271/273 |
| 4,669,720 | 6/1987 | Rosati | 271/182 |
| 4,727,784 | 3/1988 | Sarka et al. . | |
| 5,249,790 | 10/1993 | Brame et al. | 271/182 |
| 5,346,206 | 9/1994 | Steinhart | 271/182 |

FOREIGN PATENT DOCUMENTS

| | | | |
|---|---|---|---|
| 404133959 | 5/1992 | Japan | 271/273 |

*Primary Examiner*—H. Grant Skaggs
*Attorney, Agent, or Firm*—Brinks Hofer Gilson & Lione

[57] ABSTRACT

A stop wheel assembly for use in a web-product delivery system includes a stop wheel rotatably attached to an elongated member, a clamp member attached to the elongated member, and a gas cylinder including a first end attached to the clamp member to rotate the clamp member about a pivot point to raise or lower the stop wheel. A screw received in a threaded opening of a screw supporting block may contact the clamp member to rotate the stop wheel to a desired vertical distance from a slow down belt.

25 Claims, 5 Drawing Sheets

STOP WHEEL ASSEMBLY AND METHOD FOR WEB-PRODUCT DELIVERY SYSTEM

RELATED APPLICATIONS

This application is a continuation-in-part of, and claims priority to U.S. application Ser. No. 09/005,220, filed Jan. 9, 1998, the entire disclosure of which is incorporated herein by reference.

FIELD OF THE INVENTION

The invention relates to stop wheels for delivery systems used in high speed processing of web-product exiting an adjacent cutting machine.

BACKGROUND OF THE INVENTION

In general, web or paper product delivery systems are used to transfer product from a cutting machine, and place the product in shingled streams. The shingled streams may then be transferred to a stacking machine or stacked by hand for insertion into shipping containers. These product delivery systems may accommodate a product with varying lengths, widths, and configurations. Typically, these delivery systems include one or more top belt arrangements, and one or more bottom belt arrangements with at least one slow down belt. Stop wheels are provided for slowing down the individual products so that the product speed matches the speed of the slow down belt. Typically, this is accomplished by setting the outer perimeter of the wheel to form a nip between the slow down belt and outer perimeter of the wheel.

Prior to entering the nip, the products are in a sequential configuration with some separation between the trailing and leading edges of consecutive products. Upon entering the nip and with the help of the transition wheels and adjacent belts, the products form a shingled configuration and are pressed downward against the first stage slow-down belt by the stop wheels as they ride over the newly shingled product stream.

These conventional stop wheels, however, are not easily adjustable during set up of the delivery system and rely on the weight of the wheel or weights positioned on the wheel to accomplish the desired stop wheel force. For certain product this force may need to be increased to reduce the bump-up of the stop wheel from the product traveling beneath it. This increased force against the belt tends to reduce the life of belt, which is a costly item.

These conventional stop wheels are also typically difficult to align axially relative to other stop wheels acting on the same product stream, which affects the quality and consistency of the shingled product stream. In addition, to clear paper jams the stop wheels must be hand rotated to an "up" position. It is difficult to laterally position and align the wheel with a product path when in the up position because the stop wheel is not in close proximity to the belt. All of these factors may also affect the operating speed of the delivery system.

It would be desirable to have a stop wheel assembly which would overcome the above problems and provide a cost effective stop wheel assembly to increase operating speed and overall performance of the delivery system.

SUMMARY OF THE INVENTION

One of the aspect of the invention provides a stop wheel assembly comprising a stop wheel rotatably attached to an elongated member, a clamp member attached to the elongated member, and a gas cylinder including a first end attached to the clamp member to rotate the clamp member about a pivot point to raise or lower the stop wheel. A support arm may preferably be attached to the clamp member at the pivot point. The support arm may be operably connected to a cross-support shaft. The assembly may further include a screw supporting block attached to the support arm and a screw received in a threaded opening of the support block, with an end of the screw in contact with the clamp member. The second end of the gas cylinder may be attached to the support arm. A collar may be attached to a cross-support shaft with the support arm attached to the collar. The clamp member may preferably include an arm portion with the arm portion including an opening formed therein to receive a pivot pin. The pivot pin may also be received in an opening formed in the support arm. At least one supply tube may be operably connected to the gas cylinder. Preferably, a first supply tube and a second supply tube are operably attached to the gas cylinder. Preferably, the supply tube comprises an elongated tube including a plurality of openings. A quick disconnect coupler may be operably connected to an opening of the supply tube. The stop wheel may be comprised of steel, brush bristles, or other suitable material.

A further aspect of the invention provides for a method of operating a stop wheel assembly. A stop wheel rotatably attached to an elongated member, a clamp member attached to the elongated member, and an air cylinder including a first end attached to the clamp member are provided. Gas is supplied to the cylinder. The clamp member is pivoted about an axis point. And, the vertical position of the stop wheel relative to the belt is adjusted. The stop wheel may be rotated to a throw-off position. The stop wheel may then be moved laterally along a cross-shaft. A screw supporting block with a screw received in a threaded opening formed in the screw supporting block may be further provided. The screw may be turned and the screw may contact a portion of the clamp member to set the desired vertical distance of the stop wheel from a belt. The gas, which may preferably include air, may be supplied to an On side of the cylinder to lower the stop wheel, and to an Off side of the cylinder to raise the stop wheel.

A further aspect of the invention provides for a method of operating a stop wheel assembly comprising supplying pressurized gas to a cylinder, pivoting a clamp member operably attached to the cylinder about an axis point in a first direction, contacting a product on a belt with a stop wheel operably attached to the clamp member, and contacting a portion of the clamp member with a screw to pivot the clamp about an axis in a second direction.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
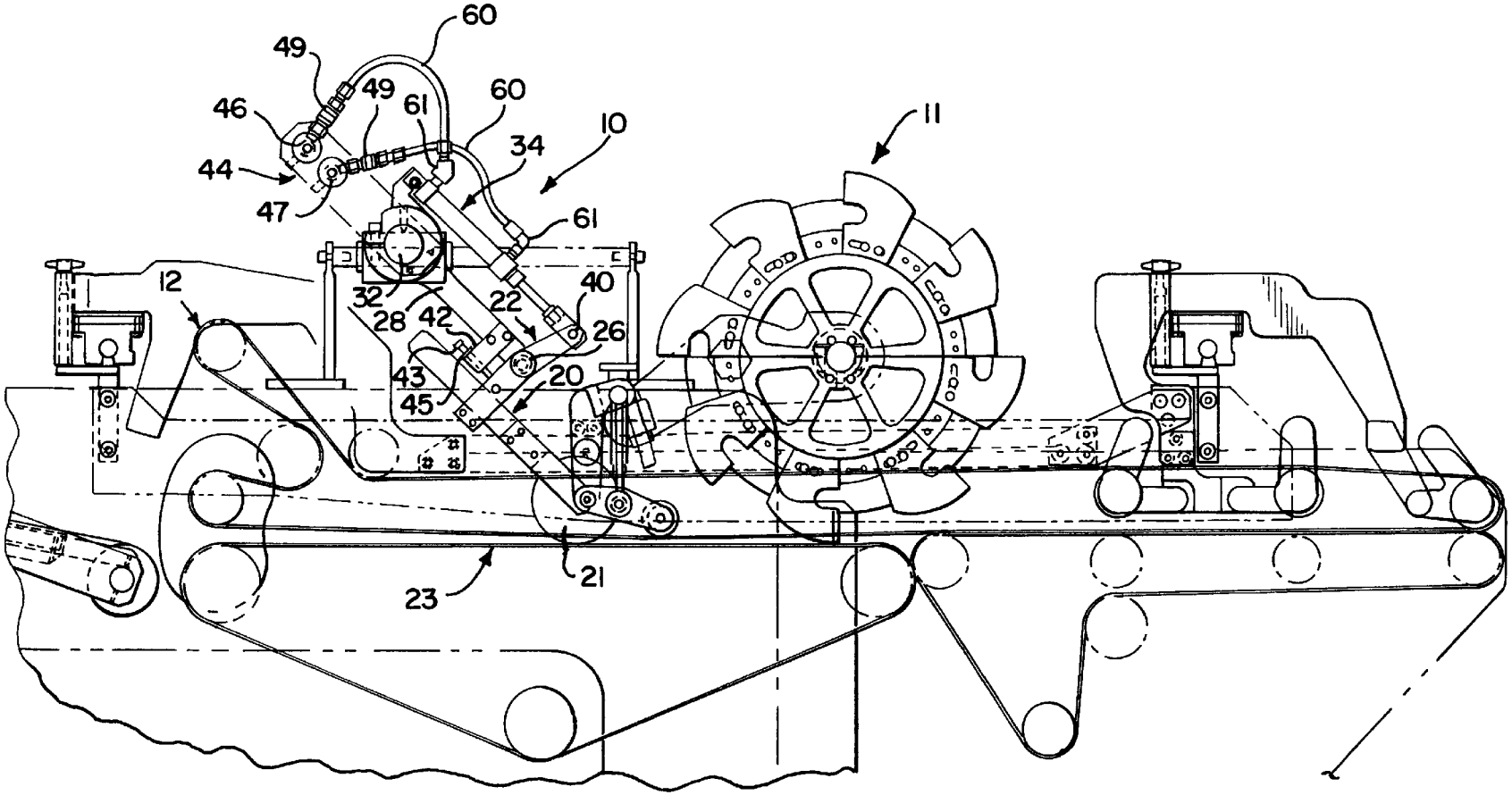
FIG. 1 is a side elevational view of a preferred embodiment of the stop wheel assembly in a down operating position, made in accordance with the invention positioned in a web-product delivery system.

Referring to FIG. 1, a preferred embodiment of a stop wheel assembly 10 comprises a stop wheel 21 rotatably attached to an elongated member 20, a clamp member 22 attached to the elongated member 20, and a gas cylinder 34 including a first end attached to the clamp member 22 to rotate the clamp member 22 about a pivot point 26 to raise or lower the stop wheel 21. The stop wheel assembly 10 allows the operator to raise and lower the stop wheel 21 from the surface of the product streams or supporting first stage slow-down belt 23 by actuation of the related air cylinder 34. The stop wheel 21 may also be quickly laterally positioned across the product/belt path by raising the stop wheel 21 to a "throw-off" position, and moving the stop wheel 21 along the cross-support shaft 32 to the desired location.

Figure 2:
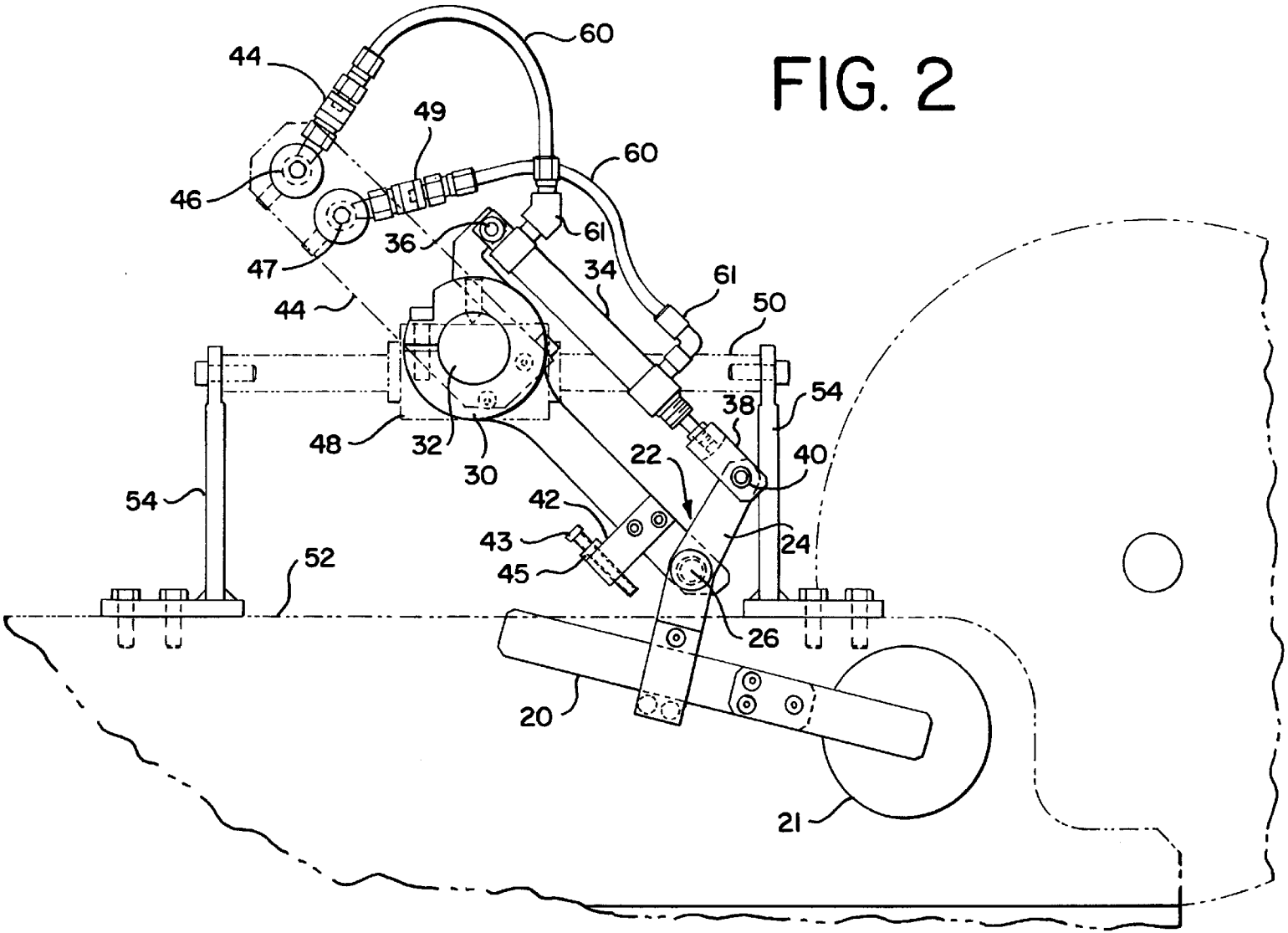
FIG. 2 is a side view of the stop wheel assembly of FIG. 1 in a "throw-off position"
Figure 3:
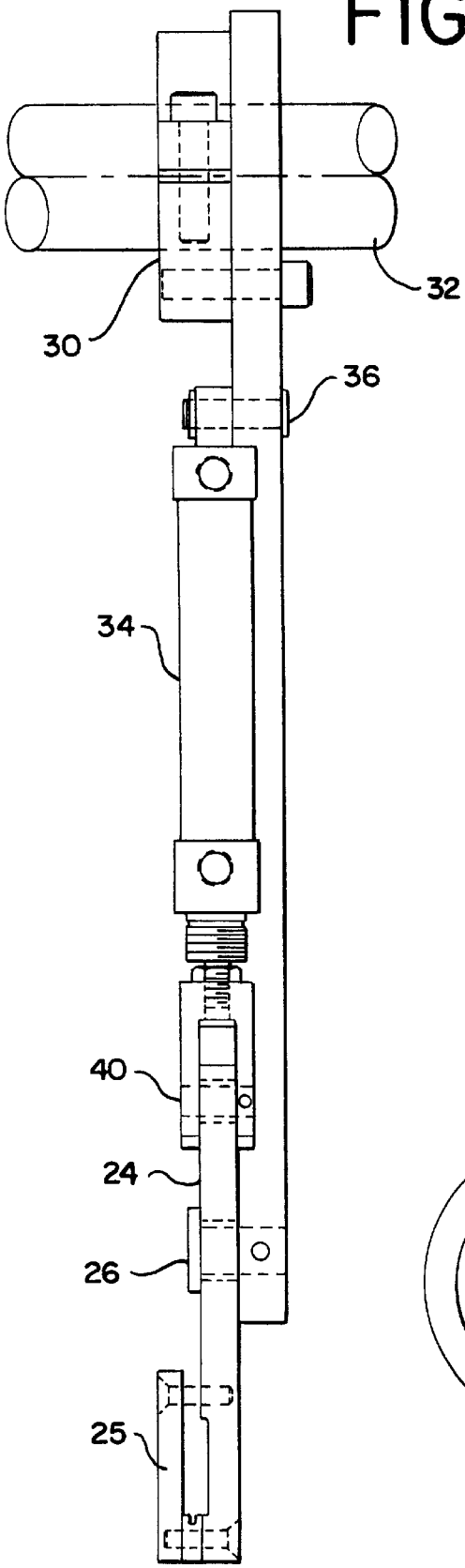
FIG. 3 is a plan view of the stop wheel assembly shown in FIG. 2.
Figure 4:
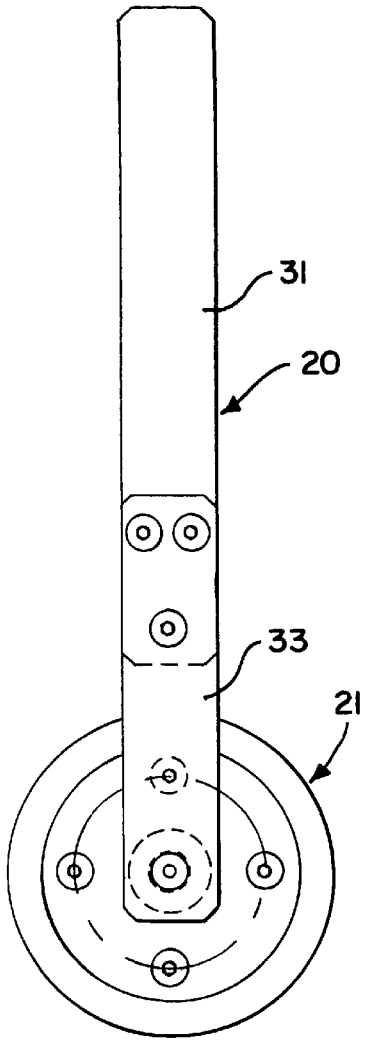
FIG. 4 is a side view of a preferred embodiment of the stop wheel rotatably attached to an elongated member.
Figure 5:
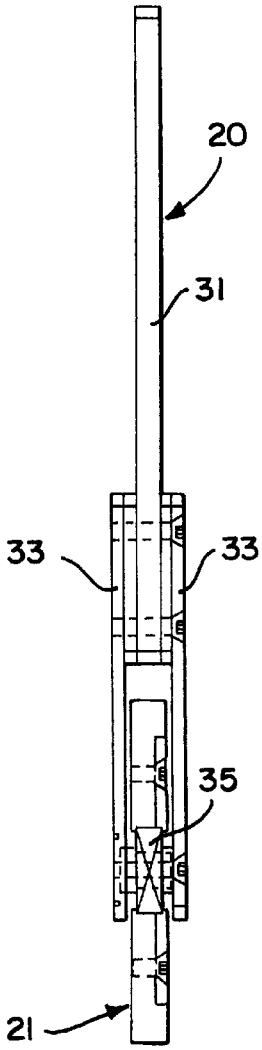
FIG. 5 is a sectional view of the embodiment of FIG. 3.

In the embodiment shown in FIGS. 1-3, one or more stop wheel assemblies 10 may be mounted on the cross-support shaft 32 as required for the particular application. The elongated member 20 may be comprised of one or more parts. Referring to FIGS. 4 and 5, a preferred embodiment of the stop wheel 21 is shown rotatably attached to the elongated member 20, which includes arm member 31, screwably attached to bracket members 33. The arm member 31 is rotatably attached via bearing 35 to the bracket members 33 with screws. The stop wheel 21 is preferably made of steel, (M1020 Hot Roll Flat), but may be made of other materials including aluminum, plastic, wood, or other metal or composite materials. The perimeter of the stop wheel 21 may be covered with various materials, which may vary widely. Stop wheel configurations may be constructed to satisfy the slow-down requirements, which are best suited to a particular product. The stop wheel assembly 10 may be easily removed when not being used.

Material, for example, Velcro™ strips may be placed around the contact surface of the stop wheel 21.

Figure 7:
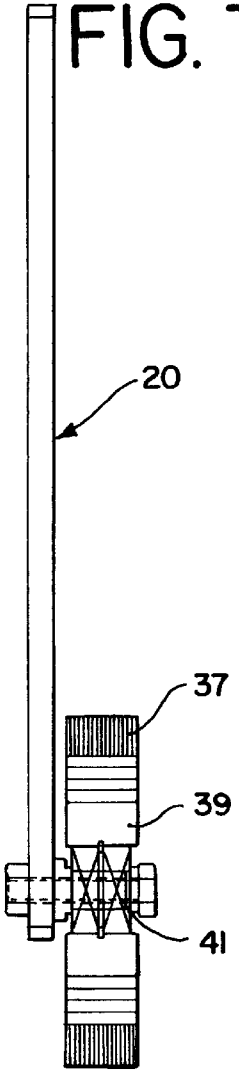
FIG. 7 is a sectional view of the embodiment of FIG. 6.
Figure 6:
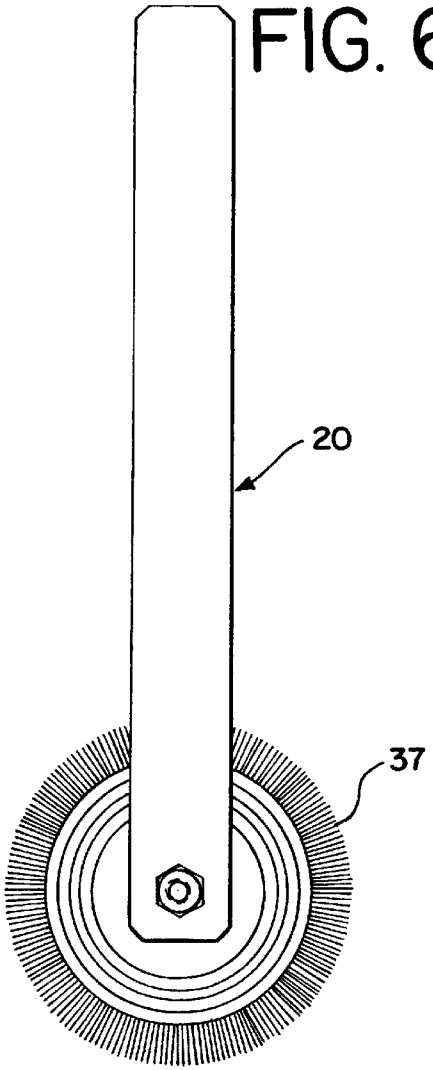
FIG. 6 is a side view of an alternative preferred embodiment of the stop wheel rotatably attached to an elongated member.

Alternatively, as shown in FIGS. 6 and 7, the stop wheel 21 may be, for example, comprised of brush bristles 37 attached to brush head 39. The brush head is rotatably attached via bearings 41 to the elongated arm 20 with a screw and nut. The brush bristles 37 may preferably be made of nylon and have a length (extending from the brush head 39) ranging from, for example, ⅛ to 1 inch, depending on the application and product configuration.

Figure 12:
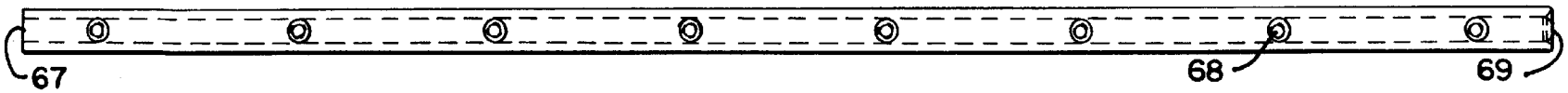
FIG. 12 is a side view of the supply tube of FIG. 1.

In the embodiment shown in FIGS. I and 2, two support brackets 44 may be affixed to opposite ends of the stop wheel cross-support shaft 32 and support two supply tubes 46, 47 which are positioned parallel to the cross-support shaft 32, and are within close proximity of the gas cylinder 34. It is contemplated that one supply tube and a gas cylinder 34 comprising a gas spring may alternatively be used to rotate the clamp member 22 to vertically raise or lower the stop wheel 21. As shown in FIG. 12, the supply tubes 46, 47 may include a plurality of spaced apart openings 68 to provide access ports. The supply tubes 46, 47 preferably include an open end 67 to receive pressurized gas, and plugged end 69. For the embodiment shown, the supply tubes 46, 47 may have a length of 41⅞ inches and include openings 68 spaced at 2⅛ inches from the ends and 5⅜ inches between openings 68. As shown in FIG. 1, one of the air supply tubes 46 provides regulated air to an "ON" end of the air cylinders 34 and the other tube 47 provides air to an "OFF" end of the air cylinders 34 via flexible air tubing 60, tube fittings 61, and quick disconnect couplers 49.

For the embodiment shown in FIGS. 1 and 2, the flexible tubing 60 may, for example, include ¼ diameter Poly Flo Tubing with Poly Flo Push Lock Straight Fitting 68 PL 04/02 ⅛ inch N.P.T. Thread x ¼ inch O.D. Tube at each end. The tube fittings 61 may include, for example, 45° and 90° street elbows. The quick disconnect couplers may include, for example: a combination of a coupler, Rectus male socket, K2-2138 (⅛ inch MNPT), Series 21; and a nipple, Rectus female plug, N3-212B-M (⅛ inch FNPT), Series 21.

For the embodiment shown, for example, manually operated four-way air valves may route pressured air to either the "ON" or "OFF" air supply tube. When the "ON" air supply tube 46 is pressurized, the stop wheel 21 is lowered down to the first stage slow-down belt 23 which is the normal run position. The force of the stop wheel 21 produced as the product stream is passed underneath is dependent on the level of air pressure being supplied to the "ON" air supply tube 46 and connected air cylinders 34. This pressure may be manually controlled with an air regulator, and control components, which may include any conventional regulation and control components, for example: Four-way air valve—Bimba 4MV8 (controls manual On-Off position); Quick Exhaust/Shuttle Valve—Horton Product No. 945100 (controls automatic On-Off position); Air Regulator—Watts R384-01-C (sets operating pressure); and Air Control Valve—Parker S-25B (controls the speed of activation by restricting the rate of air exhausting from the "Off" air supply tube).

When the "OFF" air supply tube 47 is pressurized, the stop wheel 21 is quickly raised about 2½ inches above their normal run position (FIG. 1) to the throw-off position (FIG. 2). The capability to raise, or throw-off the stop wheel 21 is advantageous since product upsets and stream irregularities, which frequently occur during start-up, may be passed through below the raised stop wheel 21, thus avoiding the possible creation of a serious impasse to product flow. The stop wheel 21 may also be automatically raised when the top belt carriage 12 is raised, and preferably may also be lowered when the carriage is in the raised position.

The gas cylinder 34 may be any conventional gas cylinder including an air cylinder, for example, a Bimba Air Cyl. 042-DPK. Referring to FIGS. 2, and 3, the pivoting arm 24 of the clamp member 22 is free to pivot about a bearinged pivot pin 26, which is preferably fixed to a pivot support arm 28. The support arm 28 may preferably be connected to a positioning collar 30 which is preferably mounted on the stop wheel cross-support shaft 32. The pivot support arm 28 may also provide pivot support for the rear pivot end of the gas cylinder 34 via a pivot pin 36. The clevis end 38 of the gas cylinder 34 may preferably be connected to the end of the pivoting arm 24 of the clamp 22 via a bearinged clevis pin 40.

Figure 9:
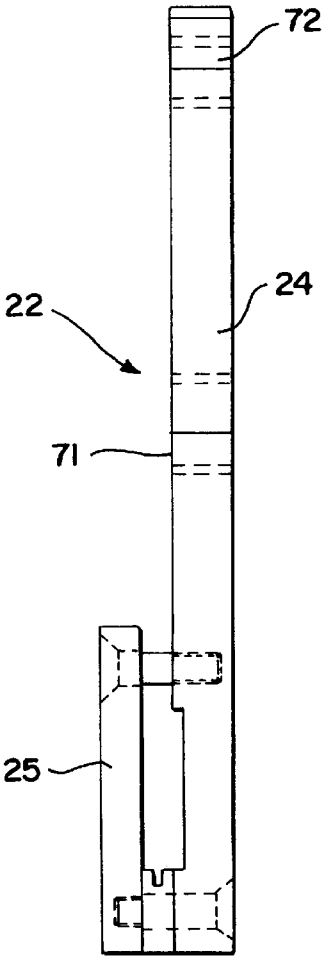
FIG. 9 is an end view of the clamp member of FIG. 8.
Figure 8:
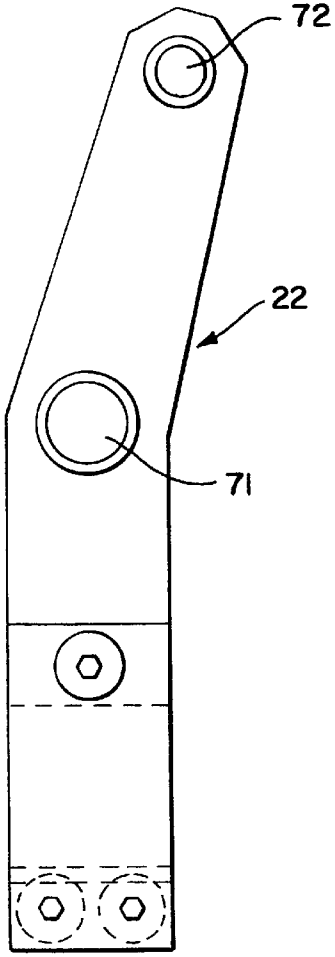
FIG. 8 is a side view of the clamp member shown in FIG. 1.

Referring to FIGS. 8 and 9, the clamp member 22 includes pivoting arm 24 and clamp arm 25. The clamp member is preferably made of steel or other rigid material, and is designed to receive the elongated arm 21, which may be secured with screws or other conventional fasteners between the pivoting arm 24 and clamp arm 25. The clamp arm 24 includes opening 71 to receive bearinged pivot pin 26, and opening 72 to receive clevis pin 40.

Figure 10:
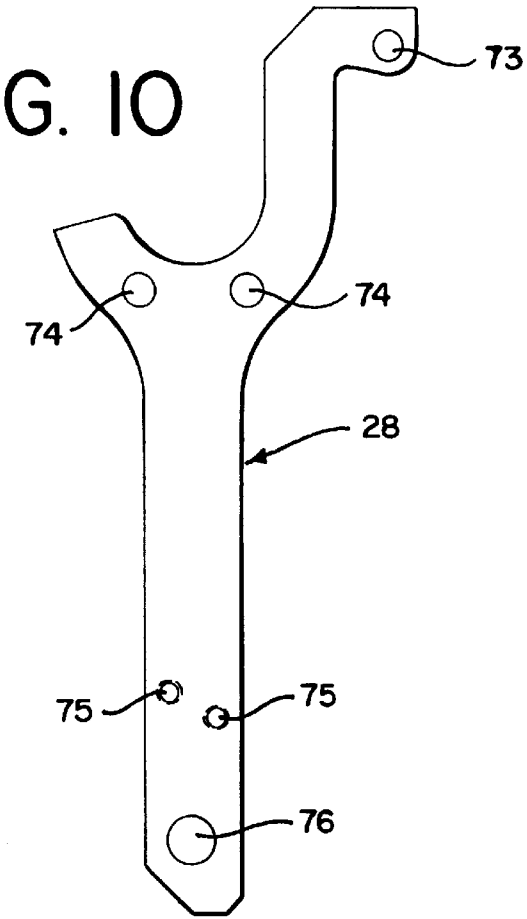
FIG. 10 is a side view of the support arm shown in FIG. 1.
Figure 11:
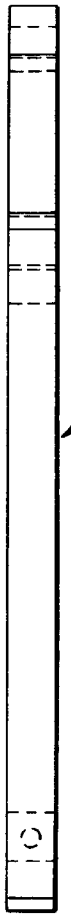
FIG. 11 is an end view of the support arm of FIG. 10.

Referring to FIGS. 10 and 11, the support arm 28 may also preferably be made of steel or other rigid material. The support arm 28 Includes opening 73 for receiving pivot pin 36, openings 74 for receiving fasteners for securing the support arm 28 to collar 30, openings 75 for receiving fasteners for securing a stop screw support block 42 to the support arm 28, and opening 76 for receiving bearinged pivot pin 26.

Referring to FIG. 2, a stop-screw supporting block 42 is mounted to the support arm 28. The supporting block 42 is preferably made of steel or other rigid material. The related stop-screw 43 may be adjusted to contact with the clamp member 22 and prevent the stop wheel 21 from bearing down on the first stage slow-down belt 23 with excessive force caused by high pressure in the actuating air cylinder 34. If a stop wheel 21 rides directly on the belt 23 with considerable force and with no product stream in between, in time, belt damage may result.

Referring to FIG. 2, the stop wheel cross-support shaft 32 and all the attached parts mentioned above of the stop wheel assembly 10 may be supported at each end of the cross-shaft 32 with cross-shaft clamps 48. The clamps 48 are preferably fitted with linear bearings aligned crosswise to the cross-support shaft. Support shafts 50 pass through the linear bearings and are supported above the delivery frames 52 with brackets 54 which are attached to the ends of the support shafts 50 and mounted on top of the frames 52. This arrangement provides for easy positioning of the stop wheel cross-support shaft 32 and attached stop wheel assembly 10 along the direction of travel of the product/first stage slow-down belt 23. This capability is advantageous in that all of the stop wheel assembly 10 may be moved together and quickly positioned to accommodate different product lengths.

Individual stop wheel assemblies 10 may also be removed or raised and held above the normal running position by utilizing the stop wheel clamp member 22. This clamping member 22 may also be used to position individual stop wheels in axial alignment relative to each other. Axial positioning adjustment relative to stop wheel 21 acting on the same product stream may affect the quality and consistency of the shingled product stream, which are factors in determining operating speed.

The quick disconnect couplers 49, as previously mentioned, expedite the removal or remounting of the stop wheel assembly 10; and, provide for quick de-activation of the air cylinder 34 in situations when actuation is not wanted, such as when the related stop wheel 21 is not being used. The above additional capabilities may be used optionally as determined by the operator.

In operation, the operator may quickly raise (throw-off) the stop wheel 21 by activation of the air cylinder 34 to clear product jams, and maintain product flow consistency. The operator may also easily control the stop wheel force on the product stream and first stage slow-down delivery belt while in the normal running condition with the manually controlled air regulator. Because different products have different product flow characteristics, it is advantageous to quickly and precisely control the force setting of the stop wheel. The stop wheel assembly 10 is designed for quick optimization of the stop wheel force after observing the effect of the force on the running product stream.

Referring to FIG. 2, the adjustable stop screw 43 and supporting block 42 are provided for each stop wheel assembly 10 to protect the first stage slow-down delivery belt 23 from damage. The adjustable stop screw 43 may also be used to set the stop wheel 21 to a minimum distance above the belt 23 in the normal running condition, which may improve product stream control in some product configurations. To set the adjustable stop screw 43, an operator may, for example, place a product on the belt, turn on the air pressure to a general setting, for example, 5 lbs. or less, which sets the stop wheel 21 against the product. The operator may then attempt to move the product or sheet from beneath the wheel. The screw 43, which may, for example, be any conventional set screw, may be turned to press against a portion of the clamp arm 24 and pivot the clamp member 22 to vertically raise the stop wheel 21 until the sheet or product is moveable. At this point, the nut 45 may be tightened to set the screw 43. The air pressure may then be increased as needed to reduce the bump-up of the stop wheel caused by the moving product without putting any additional pressure on the belt.

The quick disconnect coupling 49 is also a very convenient feature when adding stop wheel assemblies 10 to or removing them from the delivery system, or when a stop wheel assembly 10 is present but is not being used. By disconnecting the quick disconnect coupling 49, the throw-off capability of the stop wheel assembly 10 may be quickly deactivated.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A stop wheel assembly comprising:

a stop wheel rotatably attached to an elongated member;

a clamp member having a first end, a second end, and a pivot point located between said first end and said second end, said second end being attached to the elongated member;

a support arm pivotally connected to the clamp member at the pivot point;

a gas cylinder comprising a first end attached to the first end of the clamp member and a second end connected to the support arm, wherein said gas cylinder is operable to rotate the clamp member about the pivot point to raise or lower the stop wheel.

2. The assembly of claim 1 wherein the connection of the clamp member to the elongated member is adjustable along a length of the elongated member.

3. The assembly of claim 1 wherein the support arm is operatively connected to a cross-support shaft.

4. The assembly of claim 3 wherein the support arm is movable along the cross-support shaft.

5. The assembly of claim 3 wherein the clamp member includes an arm portion, the arm portion including a opening formed therein to receive a pivot pin.

6. The assembly of claim 5 wherein the pivot pin is received in an opening formed in the support arm.

7. The assembly of claim 3 further comprising at least one supply tube operatively connected to the gas cylinder.

8. The assembly of claim 7 wherein a first supply tube and a second supply tube are operatively attached to the gas cylinder.

9. The assembly of claim 7 wherein the supply tube comprises an elongated tube positioned parallel to the cross-support shaft and includes a plurality of port openings.

10. The assembly of claim 9 wherein the connection between the supply tube and the gas cylinder comprises a quick disconnect coupler configured to connect to any one of the port openings the supply tube.

11. The assembly of claim 3 wherein the stop wheel is comprised of steel.

12. The assembly of claim 3 wherein the stop wheel comprises brush bristles.

13. The assembly of claim 1 further comprising a screw supporting block attached to the support arm, a screw received in a threaded opening of the supporting block, and wherein an end of the screw is in contact with the clamp member.

14. The assembly of claim 1 further comprising a collar attached to a cross-support shaft, the support arm being attached to the collar.

15. The assembly of claim 1 wherein a supply of gas is supplied to the gas cylinder to lower the stop wheel so as to engage a product stream, said supply of gas being adjustable to alter a pressure applied by said stop wheel to said product stream.

16. A method of operating a stop wheel assembly comprising:

providing a stop wheel rotatably attached to an elongated member, a clamp member having a first end, a second end, and an axis point located between said first end and said second end, said second end being attached to the elongated member, a support arm pivotally connected to the clamp member at the axis point, and an air cylinder comprising a first end attached to the first end of the clamp member and a second end connected to the support arm;

supplying gas to the cylinder;

pivoting the clamp member about the axis point; and adjusting the vertical position of the stop wheel relative to a belt.

17. The method of claim 16 further comprising:

providing a cross-support shaft connected to the support arm;

rotating the stop wheel to a throw-off position; and moving the support arm of the stop wheel assembly laterally along the cross-support shaft.

18. The method of claim 16 further comprising:

providing a screw supporting block attached to the support arm, and a screw received in a threaded opening formed in the screw supporting block;

turning the screw; and contacting a portion of the clamp member with the screw.

19. The method of claim 16 further comprising:

supplying gas to an on side of the cylinder to lower the stop wheel.

20. The method of claim 16 further comprising:

supplying gas to an off side of the cylinder to raise the stop wheel.

21. The method of claim 16 further comprising:

adjusting a pressure of the gas supplied to the cylinder to alter a loading bias applied by the stop wheel to a product stream on the belt.

22. A method of operating a stop wheel assembly comprising:

supplying pressurized gas to a cylinder;

pivoting a clamp member operatively attached to the cylinder about an axis point in a first direction;

contacting a product on a belt with a stop wheel operatively attached to the clamp member;

contacting a portion of the clamp member with a screw, said screw being supported by a stationary screw supporting block; and turning the screw to pivot the clamp member about the axis point in a second direction.

23. A stop wheel assembly comprising:

a stop wheel rotatably attached to an elongated member;

a clamp member attached to the elongated member;

a gas cylinder including a first end attached to the clamp member to rotate the clamp member about a pivot point to raise or lower the stop wheel; and a support arm attached to the clamp member at the pivot point, wherein the support arm is operatively connected to a cross-support shaft.

24. A stop wheel assembly comprising:

a stop wheel rotatably attached to an elongated member;

a clamp member attached to the elongated member;

a gas cylinder including a first end attached to the clamp member to rotate the clamp member about a pivot point to raise or lower the stop wheel;

a support arm attached to the clamp member at the pivot point; and a screw supporting block attached to the support arm, a screw received in a threaded opening of the supporting block, wherein an end of the screw is in contact with the clamp member.

25. A stop wheel assembly comprising:

a stop wheel rotatably attached to an elongated member;

a clamp member attached to the elongated member;

a gas cylinder including a first end attached to the clamp member to rotate the clamp member about a pivot point to raise or lower the stop wheel;

a support arm attached to the clamp member at the pivot point; and a collar attached to a cross-support shaft, the support arm being attached to the collar.

* * * * *

UNITED STATES PATENT AND TRADEMARK OFFICE

CERTIFICATE OF CORRECTION

PATENT NO. : 6,089,565
DATED : July 18, 2000
INVENTOR(S) : Philip V. Voorhees et al.

It is certified that error appears in the above-identified patent and that said Letters Patent is hereby corrected as shown below:

Claims 10,
Line 4, delete "openings the" and substitute -- openings of the -- in its place.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*